United States Patent [19]

Caruccio et al.

[11] Patent Number: 4,722,272

[45] Date of Patent: Feb. 2, 1988

[54] MULTI-STATION PRINTER ADJUSTMENT MEANS

[75] Inventors: Frank Caruccio, Lynnfield; Paul H. DeWynGaert, III, Gloucester, both of Mass.

[73] Assignee: Lambert Company Inc., West Hanover, Mass.

[21] Appl. No.: 931,231

[22] Filed: Nov. 14, 1986

[51] Int. Cl.[4] ..... B41L 13/02

[52] U.S. Cl. ..... 101/126; 101/123

[58] Field of Search ..... 101/123, 126

[56] References Cited

U.S. PATENT DOCUMENTS

| | | | |
|---|---|---|---|
| 1,419,663 | 6/1922 | Erdle | 101/126 |
| 1,495,037 | 5/1924 | Patterson | 101/126 |
| 2,067,949 | 1/1937 | Rez | 101/126 |
| 2,662,470 | 12/1953 | Fordyce | 101/126 |
| 2,796,831 | 6/1957 | Heestand | 101/126 |
| 3,098,431 | 7/1963 | Weaver | 101/126 |
| 3,155,359 | 11/1964 | Hogan | 248/288.1 |
| 3,854,398 | 12/1974 | Martin | 101/126 |
| 4,517,893 | 5/1985 | Wile | 101/123 |

FOREIGN PATENT DOCUMENTS

| | | | |
|---|---|---|---|
| 2456619 | 1/1981 | France | 101/126 |

OTHER PUBLICATIONS

Antec; The New Tracer Set-up System.

*Primary Examiner*—Clyde I. Coughenour

*Attorney, Agent, or Firm*—Samuels, Gauthier, Stevens & Kehoe

[57] ABSTRACT

A silk-screen printer wherein the clamp holding the silk screen may be adjusted along X, Y and Z axes.

The screen is held on an arm secured to a cylindrical post by an anchor plate. The anchor plate is pivoted by means of adjustment bolts that extend through the plate into contact with the cylinder surface.

6 Claims, 9 Drawing Figures

MULTI-STATION PRINTER ADJUSTMENT MEANS

BACKGROUND AND BRIEF SUMMARY OF THE INVENTION

This invention relates to a printer for multi-color silk screen printing.

In the printing of fabrics, such as T-shirts, caps and the like, multiple silk screens are used for the application of various colors to form a composite print. The printer generally comprises a stand and secured to the stand are pallets on which are secured the articles to be printed. The article is usually secured to the pallet with clamps or a hold down unit. The pallet, or each pallet when more than one is used, defines a station. The pallet may or may not be adapted for rotation about the stand.

Rotatively secured to the stand, above and spaced apart from the pallets, are a plurality of printing heads arranged in a carrousel-like configuration. The heads rotate and each head will automatically lock into position in register with a pallet.

Generally the head comprises a frame and a silk screen received in the frame with clamps to secure the silk screen. Additionally, the heads are biased in an upper position such as by springs, pneumatic devices and the like. Clamps, bolts, screws and the like are used to fine-tune or micro-adjust each silk screen. This adjustment is to ensure registration of the successive applications of the silk screen to the fabric to be printed. As is well understood, each silk screen embodies a different portion of the total design and each normally applies a different color.

In the commercially available units, there are modular units whereby one to four colors may be applied with a single printer. However, when more colors are to be applied, a more expensive printer is required and generally six and eight color printers are sold separately. Further, the micro-registration systems commonly used in these printers adjust the clamps which secure the screens.

It would be desirable if a printer could be provided which could be used to print one, two, three, four, five, six, seven or eight or any combination of colors by the simple addition of pallets and heads to a basic printing unit. Further, it would be advantageous if a micro-adjust system were available which functioned independently of the clamping mechanisms which holds the silk screen and additionally could adjust the screen along several directions.

Basically the invention comprises a printer which comprises a base structure to which may be secured any combination of pallets and printing heads. The heads are carried on arms. The anchor plates which hold these arms to the base are each adjustable to ensure these arms are parallel with the arm carrying the pallet. The arm carrying the head is also adjustable along its longitudinal axis. Positioning bars are secured between pallet arms and an alignment shaft is secured to each pallet arm. An orifice is provided in the adjustable portion of the arm carrying the head. This orifice receives the alignment shaft during printing to ensure registration and locking of the arms.

In another aspect of the invention, the assembly holding the silk screen is adjustable along the perpendicular X, Y and Z axes, and can sidle adjust along the Z axis.

DESCRIPTION OF THE PREFERRED EMBODIMENT

Figure 1:
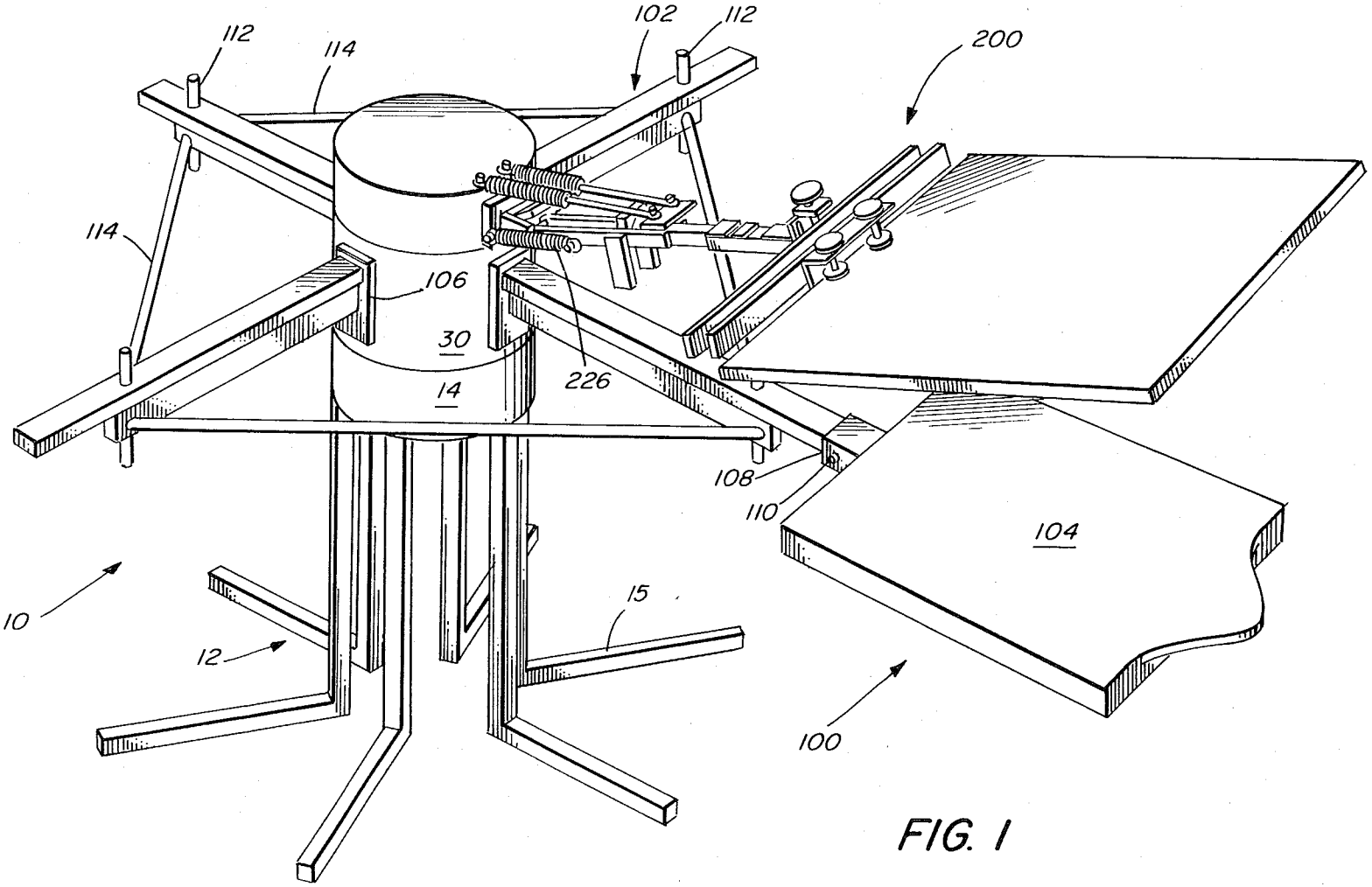
FIG. 1 is a perspective illustration of a printer embodying the invention configured as a four station printer.

A four-station printer 10 is shown in FIG. 1 and comprises a stand 12 to which is secured a pallet assembly 100 and a print head 200. Three pallet arms are shown without pallets and only one print head is shown for clarity. Regardless of the number of printing stations, the pallet assemblies and printing heads are identical.

The stand 12 comprises a lower cylindrical wall (cylinder) 14 to which are secured six legs 15.

Figure 2:
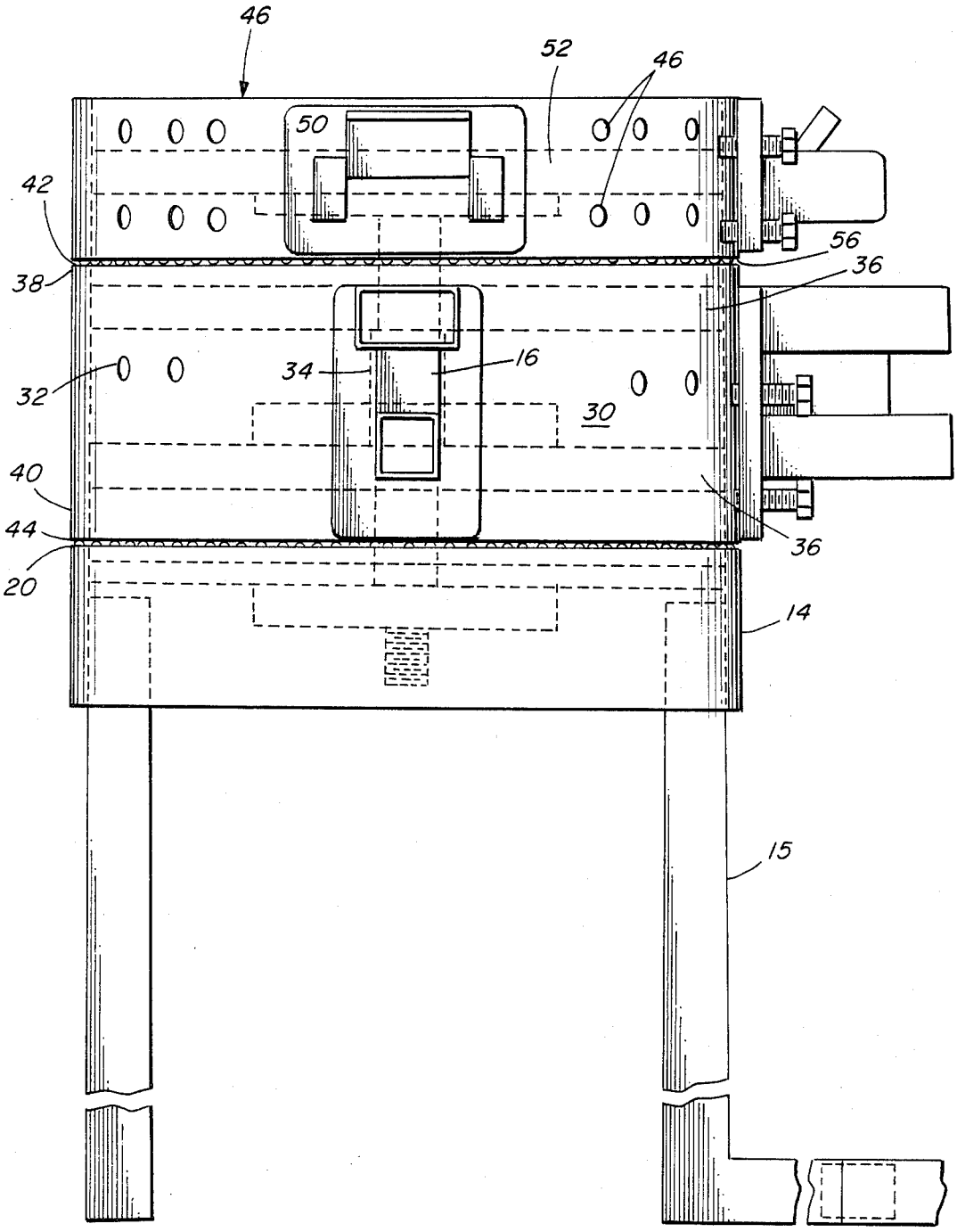
FIG. 2 is a partial side view of FIG. 1.

Referring to FIG. 2, a vertical shaft 16 is secured to the lower cylinder 14, its axis coincident with the longitudinal axis of the cylinder. The upper edge of the cylinder 14 is characterized by a race 20.

Figure 3:
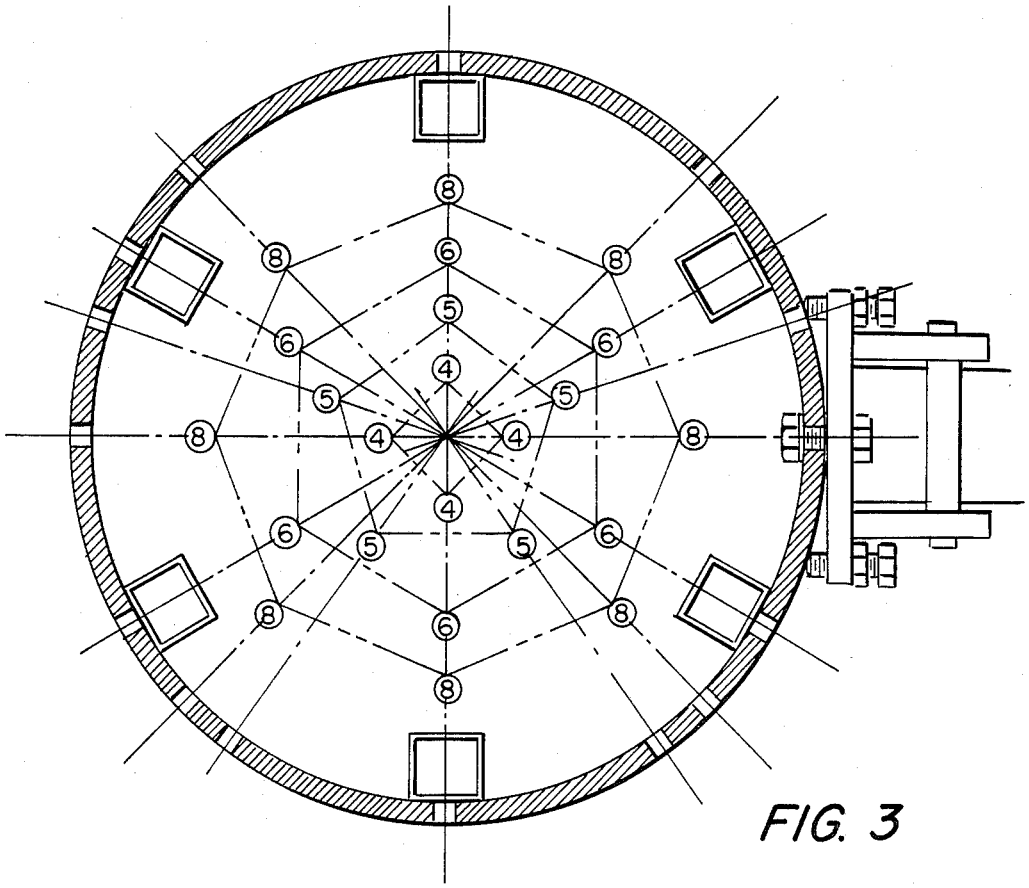
FIG. 3 is a top view illustrating the potential combinations of printing stations.

A middle cylindrical wall (cylinder) 30 is characterized by a plurality of paired holes 32, the geometric relationship of which is shown most clearly in FIG. 3. A sleeve 34 is joined to the cylinder 30 by support arms 36. The sleeve is rotatably received on the shaft 16. The upper and lower edges, 38 and 40, of the cylinder 30 are characterized by races, 42 and 44. When assembled the races 44 and 20 of the middle and lower cylinders define a track which carries ball bearings. These bearings support the middle cylinder and provide for relative rotational movement between the upper and lower cylinders.

Referring to FIG. 1, each pallet assembly 100 comprises an arm 102. At one end of the arm is a pallet 104 (as well understood in the art) and at the other end is an anchor plate 106 by which the pallet assembly 100 is secured to the middle cylinder 30. The pallet assemblies are bolted to the cylinder 90° apart. The pallet 104 includes a channel 108 in which the arm 102 is slideably received. The pallet 104 is adjustable along the arm, as desired, and is secured by a locknut 110. As the number of stations increases, the pallet is moved outwardly to provide sufficient clearance between stations.

An alignment shaft 112 extends through each arm 102. Secured to the alignment shafts 112 and each securing an adjacent pallet arm 102 are alignment bars 114. These alignment bars provide rigidity to the pallet assemblies.

Referring to FIG. 2, an upper cylinder 46 is characterized by paired holes 48. A sleeve 50 is joined to the cylinder 46 and supported by arms 52. This sleeve is rotatably received on the shaft 16. The lower edge 54 of this cylinder 46 is characterized by a race 56. When assembled, the races 56 of the upper cylinder 46 and the race 42 of the middle cylinder 30 define a track which carries ball bearings. These bearings support the upper cylinder and provide for relative rotation between the upper and middle cylinders.

In FIG. 3, the geometric relationship of the positioning of the arms of the print heads and the arms of the pallet assemblies is shown. When multiple stations are used, the design geometry will determine specifically where the arms, and thereby the pallets and print heads, are to be positioned. The number and specific positions of the holes per se in the cylinders necessary to secure or anchor the arms is a matter of design choice.

Referring to FIGS. 4, 5, 6, 7 and 8, the printing head comprises an anchor plate, an arm and a micro adjust assembly. The arm comprises a base assembly 202 which is jointed to the anchor plate 204 which is bolted to the cylinder 46. The micro-adjust assembly 260 which clamps a silk screen is slidably joined to the base assembly 202. An adjustment shaft 300 effects movement of an adjustable arm in the base assembly.

Figure 4:
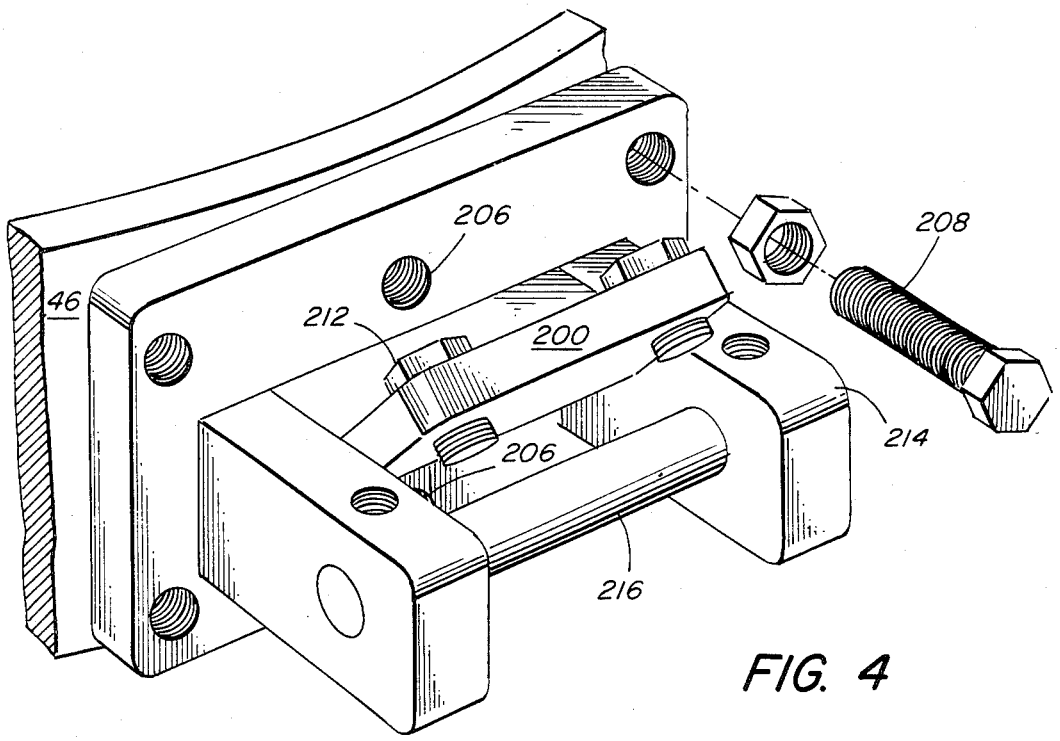
FIG. 4 is a perspective view of an anchor plate.
Figure 5:
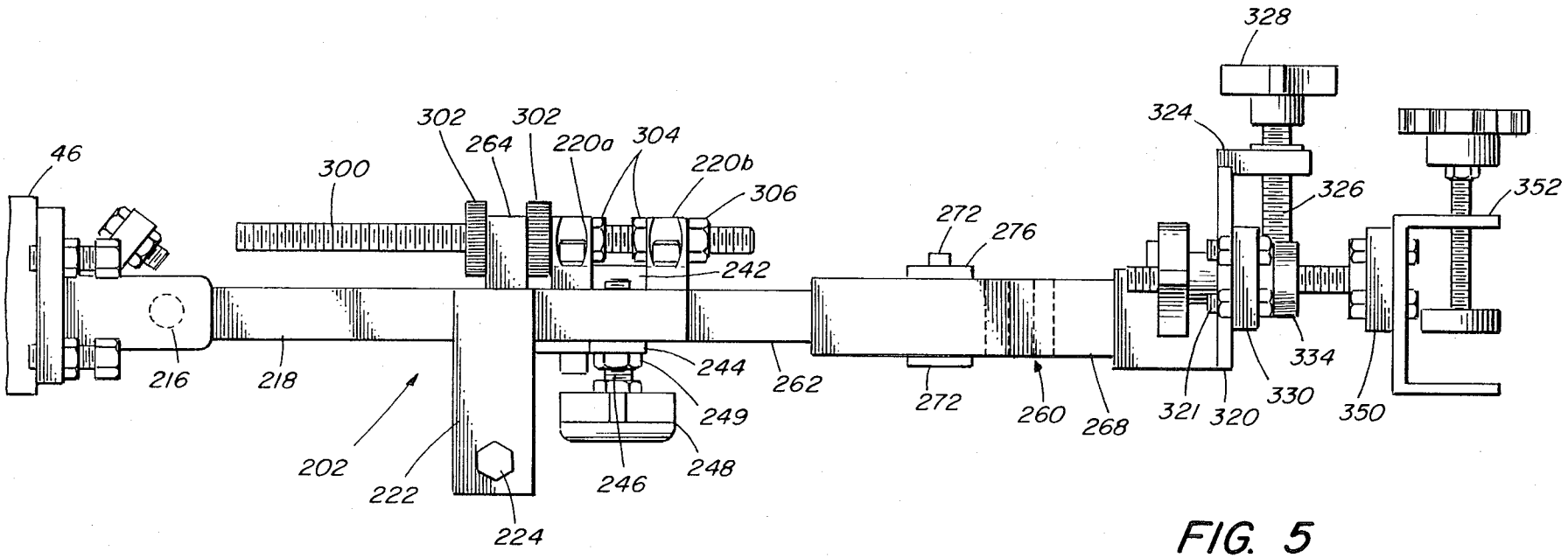
FIG. 5 is a side view of a print head assembly.
Figure 6:
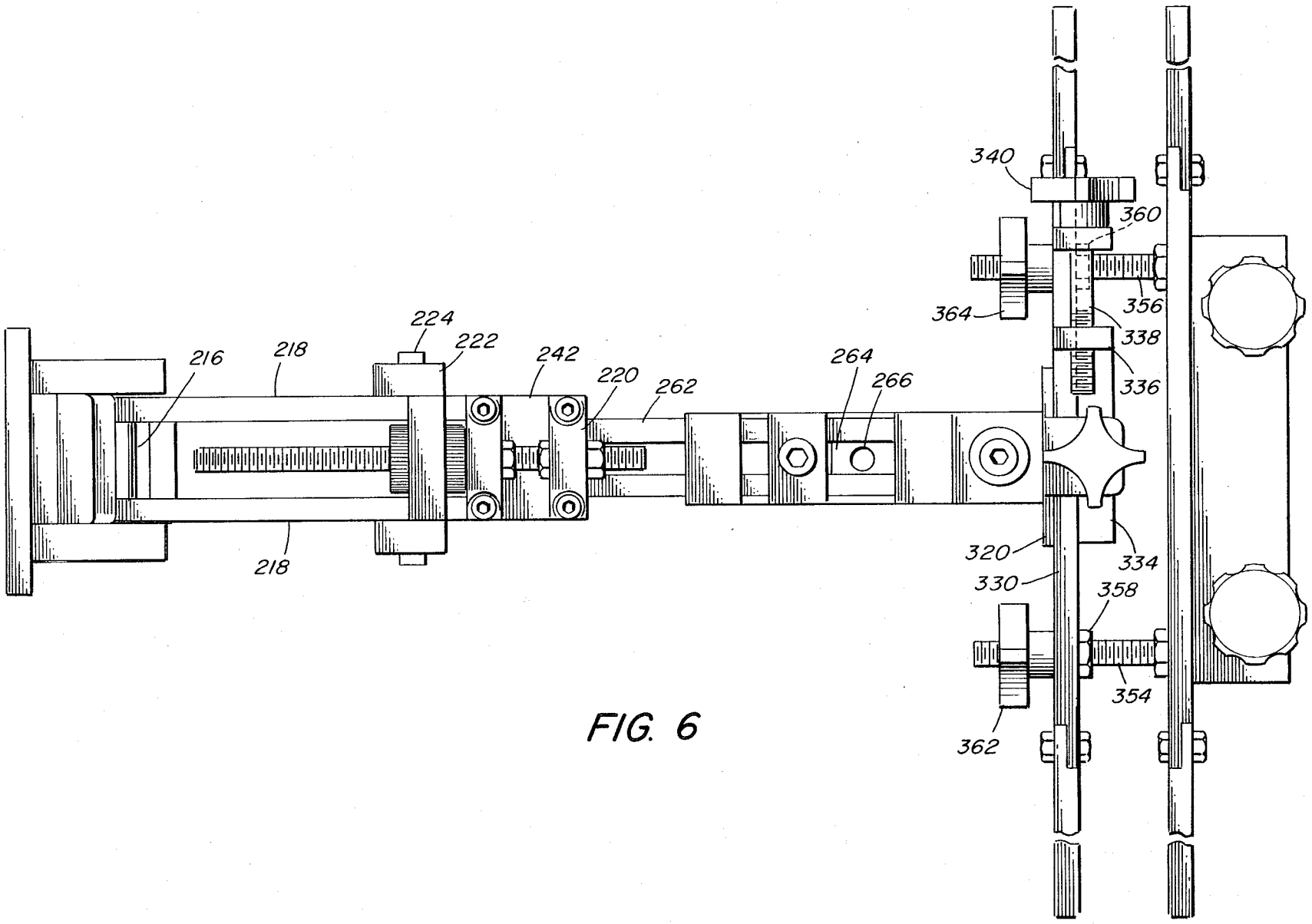
FIG. 6 is a top view of FIG. 5.
Figure 7:
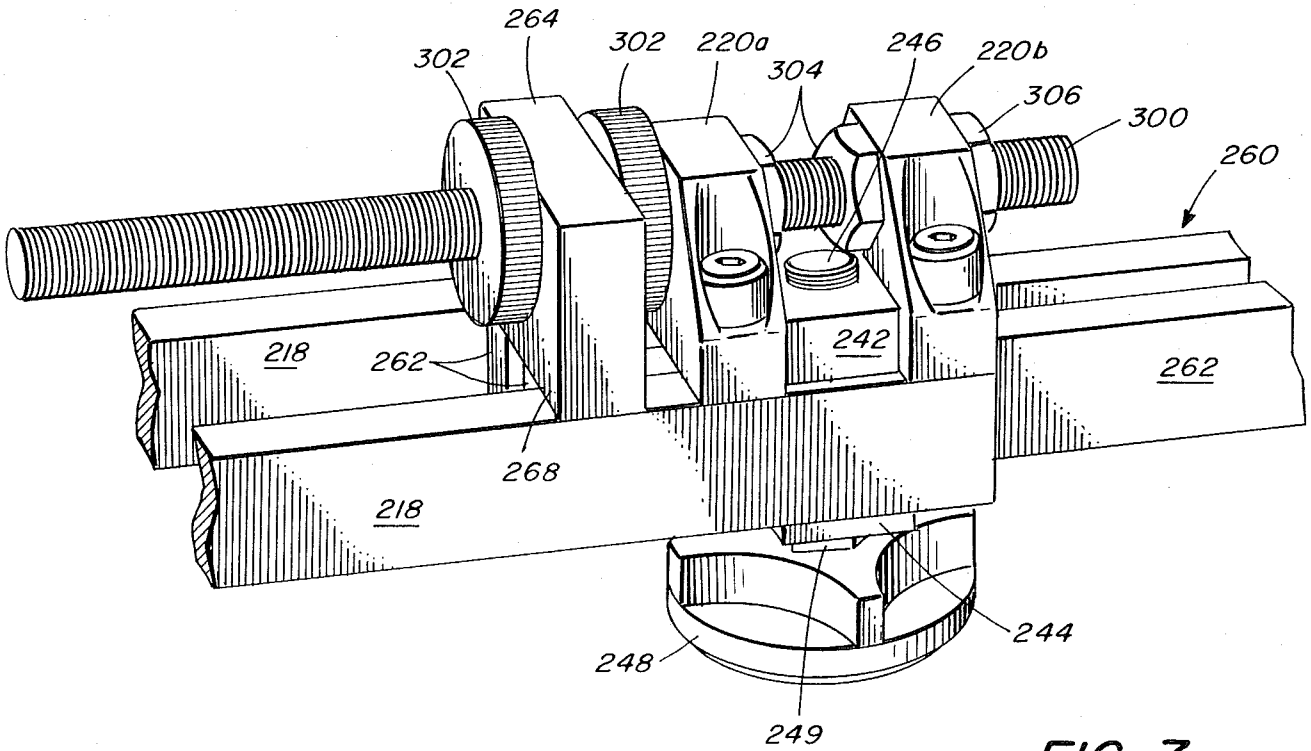
FIG. 7 is a perspective view of the print head arm.
Figure 8:
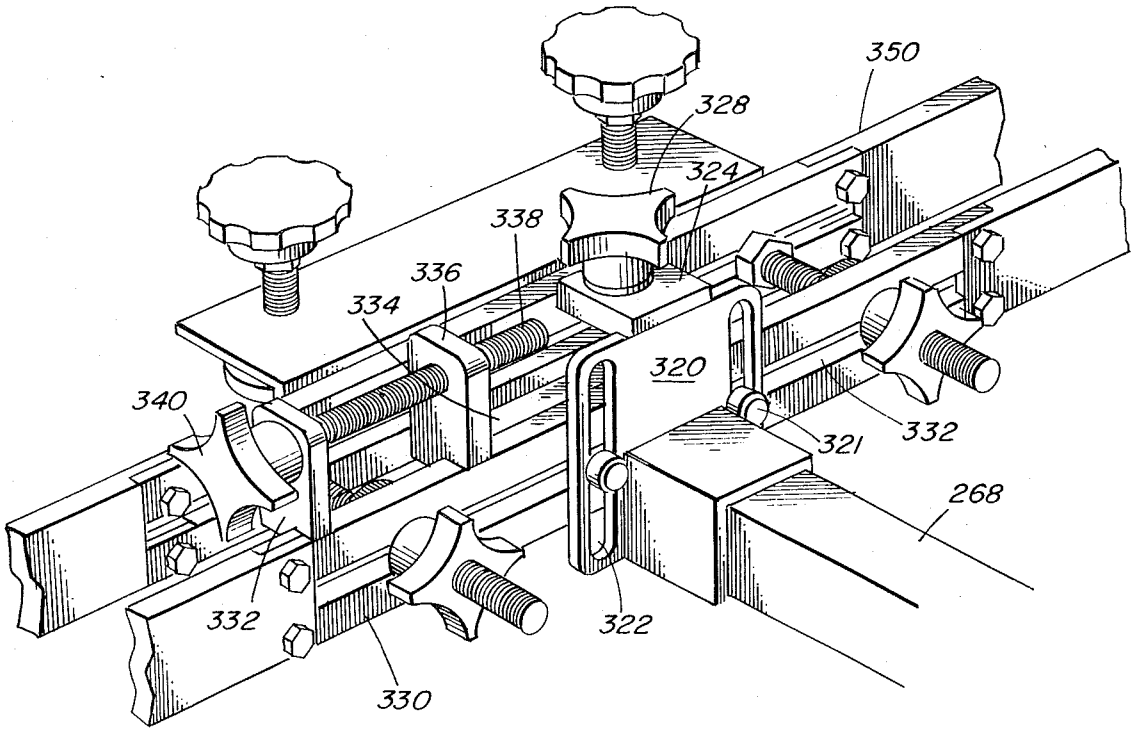
FIG. 8 is a perspective view of the micro-adjust assembly.

The anchor plate 204, see FIG. 4, has mounting holes 206 therein. Bolts pass through these holes and secure the plate to the upper cylinder. The anchor plate further includes alignment bolts 208 and a stop plate 210 which stop plate 210 carries a stop bolt 212. Parallel arms 214 extend from the plate 204. A shaft 216 is pinned to the arms 214.

The base assembly has parallel, spaced apart sides 218 which at one end are carried by the shaft 216 and at the other end have two mounting blocks 220a and 200b secured thereto in spaced apart parallel relationship. Intermediate the mounting blocks 220 and the shaft 216 are depending alignment arms 222 each carrying an alignment bolt 224.

Referring to FIG. 1, springs, shown generally at 226, are secured to the arms 218 and to the wall of the cylinder. These springs maintain, as will be described, the printing head 200 in a biased upward direction. The stop bolt 212 determines the extent of the upward movement of the printing head 200.

An adjustable arm 260 includes paired parallel sides 262 which are slidably received between the parallel sides 218. A block 264 is joined to and at the one end of the sides 262 and includes shoulders 268 which extend over the upper surfaces of the sides 218. The mounting blocks 220 and the plate 266 each include a tapped hole said holes in axial alignment with one another. Threaded through these holes is the adjustment shaft 300. Knurled wheels 302 are threaded on the alignment shaft on either side of the plate 264. Two locknuts 304 are disposed between the mounting blocks, and a locknut 306 is on the other side of the mounting block **220*b***.

Between the mounting blocks 220 is an upper lock plate 242 which extends over the sides 218 and a lower locking plate 244 which extends the width of the sides 262. The locking plates are threadedly engaged to a shaft 246 carrying a knob 248. Intermediate the knob and the lower locking plate is a locknut 249. Closing of the locking plates 242 and 244 prevents relative movement between the sides 218 and the adjustable arm 260.

At the other ends and between the sides 262 is a block 264. The block 264 has an alignment hole 266 which is to register with the alignment shaft 212 extending from the arm of the pallet assembly. If desired, a recess could be used; alternatively, shafts could be placed on the arm with a hole or recess formed in the pallet arm. In operation when the print head is moved and the alignment shaft engaged, the arms 218 and 262 are locked to prevent relative movement therebetween.

When the hole 266 is to be aligned to receive the alignment shaft 212, locking plates 242 and 244 are unclamped, the locknuts 306 and 304 are backed off and the head moved downwardly. A rough adjust is made manually. The fine adjust is made by rotating one of the wheels 302 to abut and carry the plate 264 in the desired direction (the other wheel being backed off). This causes movement of the sides 262 which carry the block 264. When the adjust has been made, the locking plates are clamped and the locknuts tightened.

The micro-adjust assembly comprises in a sandwiched array a mounting plate 320, an elongated rectangular shaped arm 268 extending perpendicularly therefrom on one side, an elongated support arm 330 abutting the other side and an alignment plate 334 on the other side of the support arm 330 and joined to the mounting plate 320. Spaced apart from the mounting plate and secured to the support arm is a clamping arm 350.

The other ends of the sides 262 are slideably received in the arm 268 which extends from the mounting plate 320 and are secured thereto. The upper and lower surfaces of the arm 268 are open. Upper and lower locking plates 270 and 272 each include shoulders which engage the upper edges of the sides of the arm 268 and have facing surfaces which engage the upper and lower surfaces of the sides 262. A clamping bolt 274 engages the plates whereby when tightened the parallel sides 262 are secured to the arm 268.

The mounting plate 320 has two parallel vertical slots 322 formed therein. Passing through these slots are locking bolts 321 which pass through a slot 332 in the support arm 330. The bolts engage the alignment plate 334. Extending at a right angle from the top of the mounting plate 230 and over the alignment plate 334 is a support 324 having a tapped hole through which passes a threaded bolt 326 which has a knob 328 at one end thereof. This bolt engages the alignment plate and is used for vertical (Y axis) adjust.

Abutting the mounting plate 320 is the support arm 330 which arm 330 is characterized by the longitudinal slot 332 through which the bolts 321 pass. The upper edge of the arm 330 has a block 332 which block extends over the alignment plate. The alignment plate 334 also has a block 336 secured to its upper surface which block extends over the support arm. The blocks 332 and 336 each include tapped holes which are in axial alignment and through which passes a threaded shaft 338 having a knob 340. Movement of the knob 340 effects relative parallel movement between the arm 330 and the alignment plate 334.

Thus, it can be seen that movement of the support arm 330 along the vertical (Y axis) is effected with the locking bolts 321 loose by turning the bolt 326. Movement on the horizontal (X axis) of the support arm 330 is effected by loosening the locking bolts 321 and turning the shaft 338 (as well as loosening the knobs 362 and 364).

Secured to the arm 330 is a clamping arm 350. This arm thereto such that a silk screen could be secured on three sides.

Threaded shafts 354 and 356 are joined to the clamping arm in a pivotal manner and pass through the slot 332 in the support arm 330. Knurled wheels 358 and 360 are disposed between the facing surface of the arm 330 and the clamping arm 350. On the other side of the support arm 330 are knobs 362 and 364 through which the shafts 354 and 356 pass. Movement of the knobs 362 and 364 and movement of the knurled wheels 358 and 360 allows movement of the clamping arm (and thereby the silk screen) in reference to the support arm.

Figure 9:
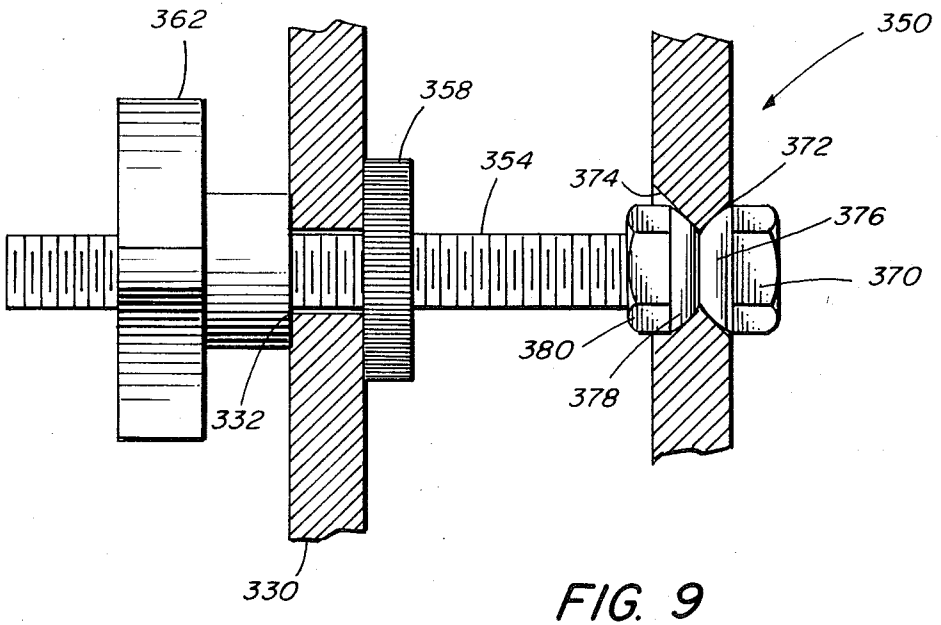
FIG. 9 is a side sectional view of a shaft secured to a clamping arm.

Referring to FIG. 9, the shaft 354-clamping arm 350 relationship which allows sidle is shown. The structure for shaft 356 is identical. The shaft 354 has a head 370. Concave surfaces 372 and 374 are formed in the arm 350 surrounding an aperture through which the shaft 354 passes. Dished washers 376 and 378 surround the shaft and are received in the surfaces 372 and 374 respectively. When an adjust requires that the clamping arm be moved at some angle to the Z axis the lock nut 380 is backed off (as well as the corresponding lock nut on the shaft 356).

If the support arm and clamping arm are in parallel relationship identical movement of the knurled wheels 358 and 360 (with the knobs backed off) will effect movement of the clamping arm toward the support arm along an axis which is coincident with the longtitudinal axis of the arm of the print head (Z axis). Movement of one of the knurled wheels with or without non-uniform movement of the other knurled wheel will allow the clamping arm to sidle or move at any desired acute angle (within the mechanical constraints of the specific configuration) with reference to the longtitudinal axis (Z) of the printing head arm. That is, a side to side movement or sidle is achieved with this construction. Movement of the knobs (with the wheels backed off) effects movement of the clamping arm away from the support arm. Once the screen has been properly reigstered both knobs, wheels and lock nuts are tightened.

After the alignment shaft from the pallet assembly has been registered with the alignment hole, the micro-adjust assembly has been secured to the arm and the silk screen has been clamped, then the silk screen may be adjusted to final registration without loosening the clamp(s) 352 which directly holds the silk screen, along X, Y and Z axes and in directions which are at acute angles with reference to said Z axis.

If it is desired to convert the four station printer shown in FIG. 1 to a six station printer, then two pallet assembly-print heads will be relocated and two additional pallet assembly-print heads will be added. Referring to FIG. 3 when in the four station configuration the print heads and pallets are located on their respective cylinders at the indications marked 4. It can be seen that when converted to a six station printer, two opposed assemblies will remain fixed, two will be moved and two will be added at the indications marked 6. When going to a larger number of stations, the adjustment bars are removed and different, properly dimensioned adjustment bars secured between the adjacent pallet arms. The locknut on the pallet sleeve is loosened and the pallet moved outwardly from the cylinders until there is sufficient clearance between the pallets to enable operators to work satisfactorily at each of the stations.

The alignment bolts 208 (four each) on the anchor plates 204 of the arms of the print head are adjusted to ensure that the arms of the print head and the arms of the pallet assemblies are parallel to one another. This may be accomplished by using a simple level.

The ends of the alignment bolts abut the cylinder surface 46. Turning the bolts causes the anchor plate to deflect with reference to the surface whereby movement of the plate will move the connected arm. The arms 262 are adjusted, as described above, until the alignment shaft on the pallet arm is in register with the alignment hole such that it is received in the hole when the print head is moved downwardly. This ensures that during the printing step there will be no relative movement between the arms of the print head and the pallet assembly. The depending arms 224 act as initial guides to ensure quick alignment.

Once this alignment has been properly made, the material to be printed is secured to the pallet(s) and the silk screens, each containing a portion of the total final design, are each secured in the clamps of the clamping arms. The necessary adjustments of the screen are as described above.

Having described our invention, what we now claim is:

1. A printer which comprises:
(a) a cylindrical housing;
(b) at least one palet secured to the housing by an arm, said arm carrying first registration means;
(c) at least one print head adapted to carry a silk screen secured to the housing by an arm, the arm characterized by a second registration means;
(d) means to effect relative rotational movement between the palet and the print head;
(e) means to align the arms one to the other with the first and second registration means being in register; and
(f) means to adjust at least one of said arms to maintain the arms in parallel relationship said means including an anchor plate means securing said anchor plate to the cylinder wall, secured to said anchor plate; at least three adjusting bolts secured to the anchor plate and extending therethrough, such that their ends contact the surface of the cylinder wall whereby turning of the adjusting bolts will cause the anchor plate to pivot and thereby the arm to deflect with reference to said surface causing the arm to move in a desired direction.

2. The printer of claim 1 where in the first registration means includes a shaft and the second registration means includes a hole.

3. The printer of claim 1 wherein the means to move the arm along its longtitudinal axis includes a first pair of sides in spaced apart, parallel relationship secured to the housing;
a second pair of parallel arms slideably engaged to the first set of arms; and
means to move the second set of arms with reference to the first set of arms.

4. The printer of claim 3 wherein the means to effect the movement include a plate secured to the second set of arms;
at least one mounting block secured to the first set of arms, a threaded shaft passing through and connecting the plate and mounting block and wheels on the threaded shaft adapted to engage the plate thereby moving the second set of arms.

5. The printer of claim 1 which includes means to bias the print head in an upward position.

6. The printer of claim 1 wherein there are four adjusting bolts arrayed in a rectangular configuration.

* * * * *